US005271512A

United States Patent [19]

Ekkert

[11] Patent Number: 5,271,512

[45] Date of Patent: Dec. 21, 1993

[54] TAMPER-EVIDENT CLOSURE WITH REINFORCED BAND

[75] Inventor: Len Ekkert, Lemont, Ill.

[73] Assignee: Phoenix Closures, Inc., Naperville, Ill.

[21] Appl. No.: 973,029

[22] Filed: Nov. 6, 1992

[51] Int. Cl.[5] ..... B65D 43/14

[52] U.S. Cl. ..... 215/252; 215/216; 215/330

[58] Field of Search ..... 215/252, 330, 331, 216, 215/253, 254, 256, 258

[56] References Cited

U.S. PATENT DOCUMENTS

| | | | |
|---|---|---|---|
| Re. 32,879 | 2/1989 | Wright et al. | 215/252 |
| 3,980,195 | 9/1976 | Fillmore . | |
| 4,156,490 | 5/1979 | Peraboni . | |
| 4,432,461 | 2/1984 | Mumford et al. . | |
| 4,436,212 | 3/1984 | Llera . | |
| 4,461,391 | 7/1984 | Davis | 215/252 |
| 4,485,934 | 12/1984 | Maguire | 215/252 |
| 4,493,427 | 1/1985 | Wolkonsky . | |
| 4,530,437 | 7/1985 | Gray et al. . | |
| 4,550,844 | 11/1985 | Lininger . | |
| 4,567,993 | 2/1986 | Albrecht et al. . | |
| 4,572,387 | 2/1986 | Luker et al. | 215/252 |
| 4,595,110 | 6/1986 | Herr . | |
| 4,679,696 | 7/1987 | Bonnenfant et al. . | |
| 4,700,859 | 10/1987 | Gregory . | |
| 4,702,383 | 10/1987 | Wender . | |
| 4,756,438 | 7/1988 | Ryder . | |
| 4,768,666 | 9/1988 | Kessler . | |
| 4,807,771 | 2/1989 | Roy et al. . | |
| 4,848,614 | 7/1989 | Csaszar | 215/252 |
| 4,913,299 | 4/1990 | Petro | 215/330 |
| 4,915,244 | 4/1990 | Celaschi et al. | 215/252 |
| 4,919,285 | 4/1990 | Roof et al. . | |
| 4,991,733 | 2/1991 | Marino | 215/330 |
| 5,135,123 | 8/1992 | Nairn et al. . | |

FOREIGN PATENT DOCUMENTS

| | | | |
|---|---|---|---|
| 2276238 | 7/1976 | France . | |
| 1361180 | 7/1974 | United Kingdom | 215/252 |
| 8304402 | 12/1983 | World Int. Prop. O. | 215/252 |

*Primary Examiner*—Allan N. Shoap
*Assistant Examiner*—Stephen Cronin
*Attorney, Agent, or Firm*—Welsh & Katz Ltd.

[57] ABSTRACT

A molded tamper-evident closure for use with a container having a neck. The closure includes a generally planar top portion with an outer peripheral edge, an annular skirt depending from the peripheral edge and having a lower edge margin, an annular breakaway band having a top surface and a bottom surface, the top surface including a plurality of spaced frangible bridge formations integrally joined to the lower edge margin of the skirt. An outer surface of the breakaway band is provided with a plurality of support formations such as gusset members for preventing distortion of the breakaway band as the closure is applied to the container. The closure may also be provided with a plurality of specially configured recess formations for engaging ratchet formations on the neck of the container to provide an anti-backoff feature.

14 Claims, 2 Drawing Sheets

5271512
FIG. 1
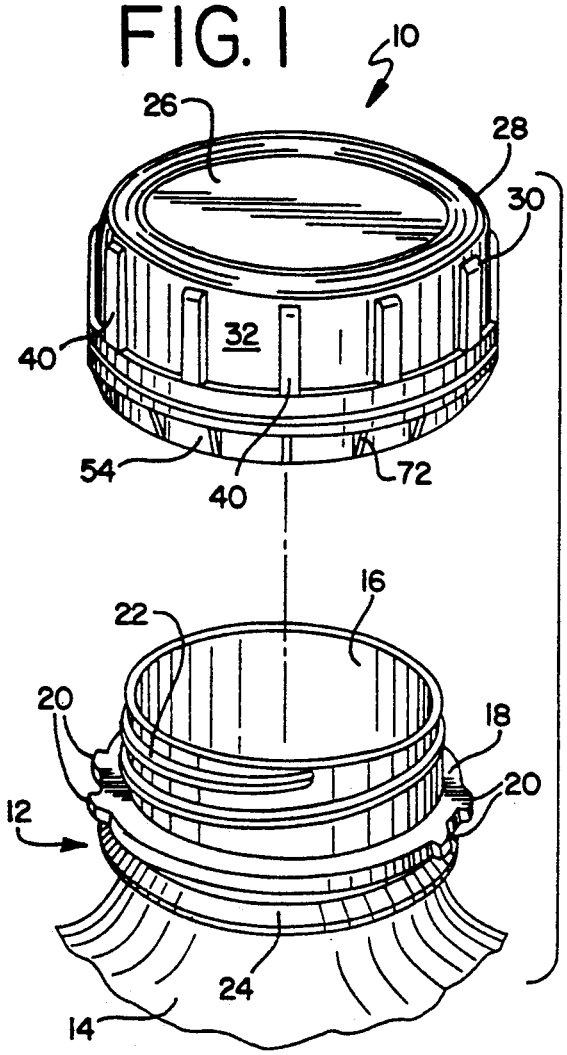
FIG. 2
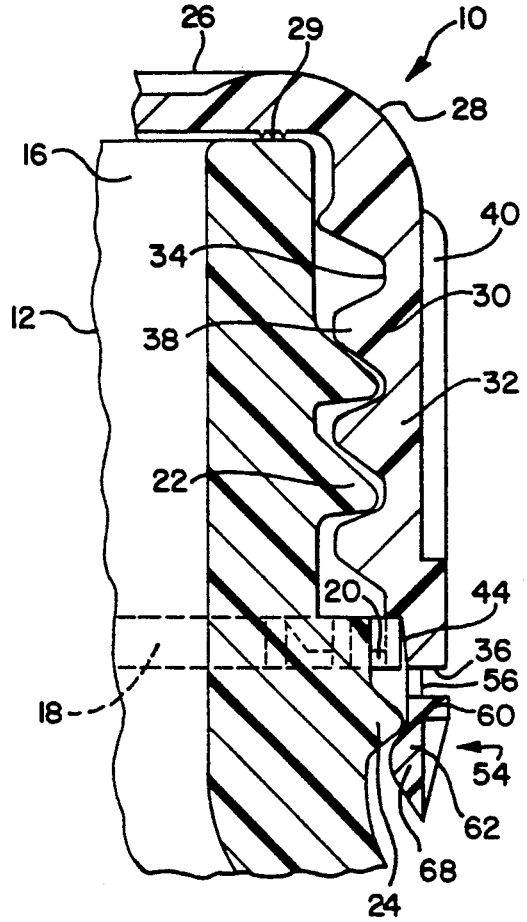
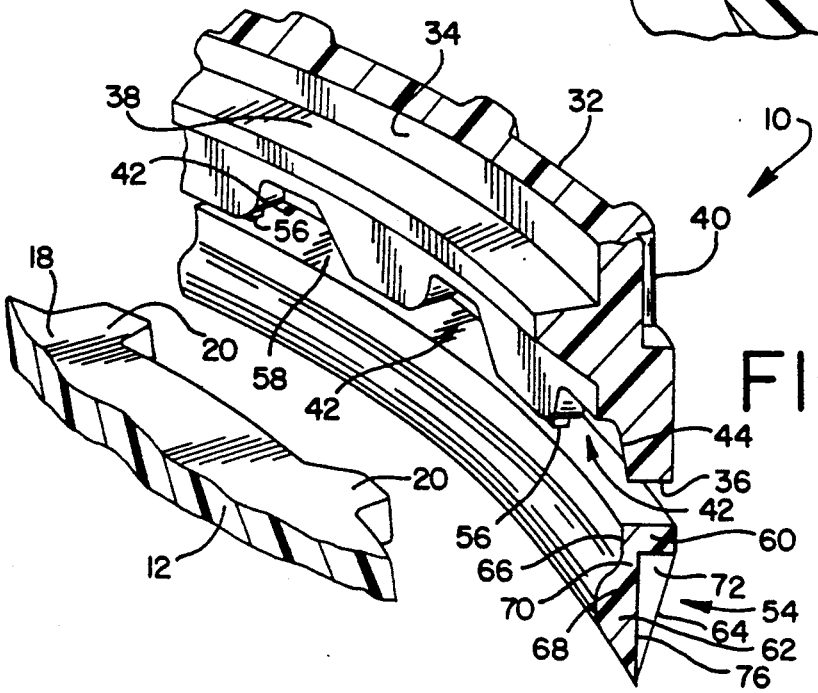
FIG. 3

TAMPER-EVIDENT CLOSURE WITH REINFORCED BAND

BACKGROUND OF THE INVENTION

The present invention relates to plastic closures for use on bottles or like containers, and specifically to a closure provided with a breakaway band as a tamper evident feature. The tamper evident feature is preferably used with a closure having a plurality of formations for preventing the container from backing-off of the closure when the container and closure are in a closed position.

Various configurations of tamper-evident container closures are known in which a frangible band breaks away from the closure upon opening. The band is connected to the closure by a number of relatively thin, easily severable bridges or pads. The closure is threaded upon the container finish or neck. An inner bead on the band engages a radially projecting locking ring on the container finish. Upon the initial opening of the container, the bridges sever and the band remains on the container finish.

A common problem with such closures is that the tamper evident band must be flexible enough to ride over the locking ring during application of the closure upon the container, yet be rigid enough to be retained upon the finish once the closure is initially opened to indicate tampering. At the same time, in order to minimize production costs, such tamper evident bands are optimally made of a minimal amount of plastic.

In many designs of breakaway bands, upon application of the closure to the container, a significant amount of frictional interference is generated between the band and the locking ring. This interference has been the bridges to collapse, forcing the band to contact the closure skirt. In other cases, the interference causes the bridge formations to sever, and the breakaway band to tuck upward between the closure skirt and the container neck, distorting the shape of the band and impairing its tamper evident effectiveness.

One attempt at solving this problem has been to thicken portions of the breakaway band for structural support in withstanding the above-identified frictional interference. However, a significant disadvantage of this solution is that the amount of material per cap increases, thus increasing the production costs as well as the shipping weight.

In addition to breakaway bands, molded plastic containers of the type employing a threaded closure member, such as bottles, jars, or the like normally include a smooth integral thread formed on the neck portion of the container. When a closure having a corresponding thread is tightened upon the smooth thread of the molded plastic container, there is a tendency for the closure to become loose. This loosening of the closure, commonly known as "backing-off", is due in part to vibration incurred during shipping and handling, to the self-lubricating qualities of the plastic materials normally used in molding the closures and containers, as well as to the tendency of such materials to flow or creep under stress, thereby permitting the closure to work itself off to relieve the stress set up in the threads due to tightening of the closure on the container. Backing-off can be a significant problem to packagers, in that containers having closures which are loose or appear to have been opened are less apt to be selected by consumers for fear of tampering and/or contamination.

Thus, it is an object of the present invention to provide a closure with a breakaway band which is configured to prevent unwanted misalignment or tucking.

It is a further object of the present invention to provide a closure with a tamper evident breakaway band which is lightweight, yet has sufficient support to withstand friction generated when the closure is applied upon the container neck.

It is another object of the present invention to provide a closure with back-off resistance, as well as with a tamper evident breakaway band.

Yet another object of the present invention is to provide a back-off resistant closure for a container having laterally projecting locking formations, the closure having formations which matingly engage the locking formations of the container surface to prevent the backing-off of the closure therefrom.

SUMMARY OF THE INVENTION

Accordingly, the closure of the present invention provides a container closure in which a tamper evident breakaway band is configured to have support to prevent unwanted shifting or tucking upon application of the closure upon a container neck. The present closure is also designed to minimize backing off, and as such includes a plurality of recesses, each configured for engaging one of a plurality of ratchet teeth circumferentially arrayed about the periphery of the container neck.

More specifically, the present invention discloses a molded tamper-evident closure for use with a container having a neck. The closure includes a generally planar top portion with an outer peripheral edge, an annular skirt depending from the peripheral edge and having a lower edge margin, an annular breakaway band having a top surface and a bottom surface, the top surface including a plurality of spaced frangible bridge formations integrally joined to the lower edge margin of the skirt, and an outer surface of the breakaway band being provided with a plurality of support structures for preventing distortion of the breakaway band as the closure is applied to the container.

BRIEF DESCRIPTION OF THE DRAWINGS

FIG. 1 is a front perspective elevational view of the closure of the invention shown exploded away from the neck of the container;

FIG. 2 is a fragmentary vertical sectional view of the closure of the invention shown in a closed and locked position upon the container of FIG. 1;

FIG. 3 is a fragmentary perspective elevational view of the interior of the present closure shown exploded away from the ratchet formations;

DESCRIPTION OF THE PREFERRED EMBODIMENT

Figure 4:
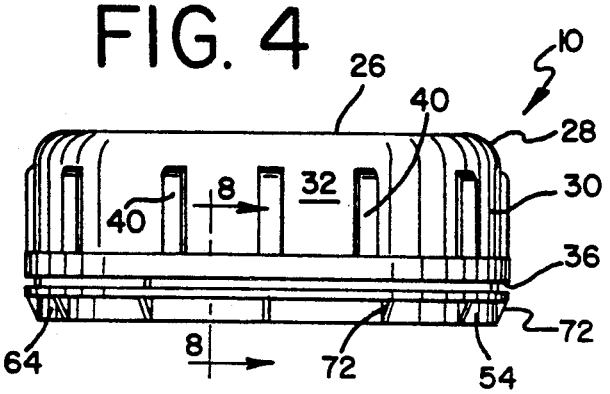
FIG. 4 is a front elevational view of the closure of FIG. 1.
Figure 6:
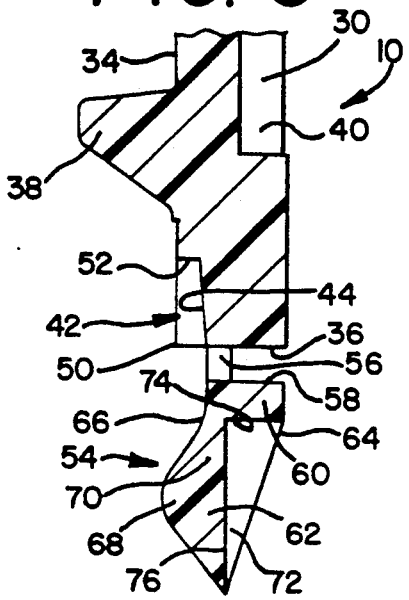
FIG. 6 is a fragmentary vertical sectional view of the lower portion of the skirt of the present closure.
Figure 5:
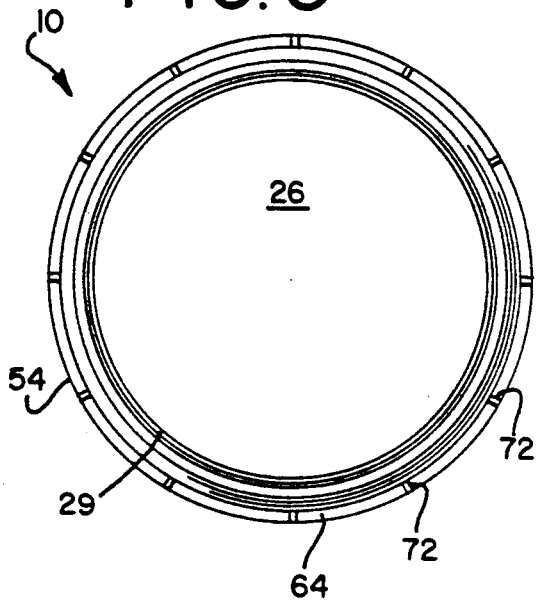
FIG. 5 is a bottom elevational view of the closure of FIG. 1.

Referring now to FIG. 1, the closure of the invention is designated generally 10, and is shown mounted upon a container generally designated 12. The container 12 has a shoulder portion 14 including a vertically projecting tubular neck or finish portion 16 having a anti-backoff ring 18 integral therewith. The ring 18 has a plurality of radially outwardly projecting tooth or ratchet formations 20. Although the formations 20 are shown as two diametrically opposed groups of two teeth each, the precise number, placement and spacing of the formations may vary with the particular application. The neck portion 18 is also provided with a helical thread 22 which is integrally formed therewith.

An annular projecting shoulder or breaker ledge 24 is disposed beneath the level of the thread 22 as well as the anti-backoff ring 18. The ledge 24 has a generally radially tapering configuration and is provided to engage a tamper evident breakaway band as will be described below. The container 12 is preferably manufactured out of a polymeric material which is thermoformable, including, but not restricted to, polyethylene or polypropylene.

The closure 10 is generally configured as a cap having a generally planar top portion 26 with an outer peripheral edge 28 and a depending annular skirt portion 30 depending from the edge 28. An upper sealing member or gasket 29 is located on an underside of the top portion 26 (best seen in FIG. 2).

The skirt portion 30 includes an outer face 32, an inner face 34 and a lower edge 36. The inner face 34 is provided with integrally formed helical threads 38 (best seen in FIG. 2) which are designed to matingly engage the threads 22 of the container 12. The outer face 32 may be provided with a plurality of vertical ribs 40 to allow the closure 10 to be installed upon a container by automatic capping equipment, as well as to facilitate gripping or manipulation by the user.

Referring now to FIGS. 3 and 6–8, the lower edge 36 of the closure 10 is provided with a plurality of spaced, open-bottomed recess formations 42 which are designed to matingly engage the ratchet formations 20 of the ring 18, as well as to assist the removal of the closure from the mold during manufacturing. In the preferred embodiment, the recesses 42 are provided around the entire lower edge 36, although the exact number and spacing of recesses 42 may vary with the application.

The closure 10 is preferably molded of a lightweight plastic material which is flexible and squeezably, resiliently deformable. Thus, when the closure is closed upon the container, as shown in FIG. 2, upon opening, the flexibility of the closure allows the recess formations 42 to ride over the ratchet formations 20 for release of the closure. Despite its deformability, the closure 10 has a "memory", in that once the user ceases the squeezing action, the closure 10 immediately resumes its original configuration.

Figure 7:
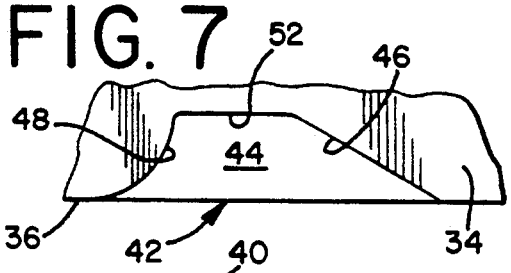
FIG. 7 is a fragmentary front elevational view of one of the ratchet recesses.
Figure 8:
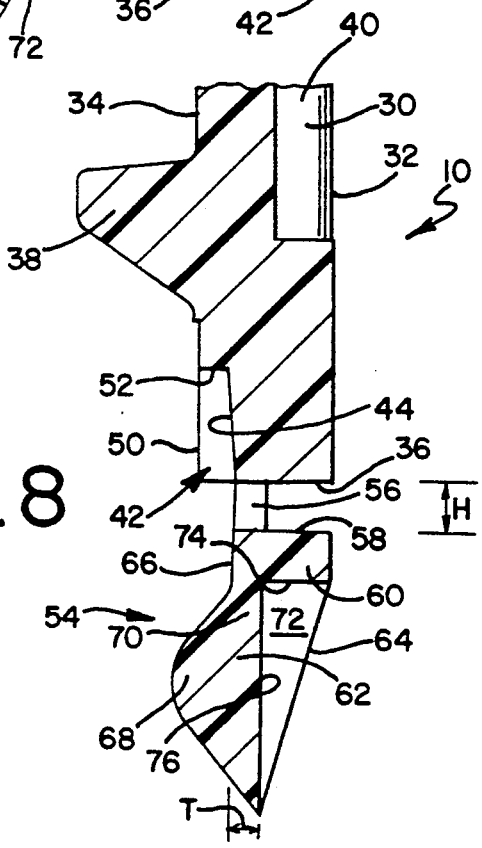
FIG. 8 is a fragmentary sectional view taken along the line 8—8 of FIG. 4 and in the direction indicated.

Referring now to FIGS. 3 and 7, the formations 42 are preferably trapezoidal in configuration when viewed from the front or rear, and are defined by lower edge portion 36 of the skirt 30, a peripheral wall 44 (best seen in FIGS. 6 and 7), a slightly angled first side wall 46, a radiused, convex second side wall 48, an open inner side 50 and a top side 52. The arrangement of the open inner sides 50 creates a ring of generally rectangular openings which enables the closure 10 to lockingly engage the ratchet formations 20 of the container 12.

Referring now to FIGS. 1, 2, 3 and 8, a breakaway band 54 is secured in slightly spaced relationship to the lower edge 36 of the skirt 30 by a plurality of generally vertically projecting bridges 56 (best seen in FIG. 8) located on an upper surface 58 of the band. It is preferred that the bridges 56 are integrally joined at lower ends to the breakaway band 54, and at upper ends to the lower edge 36 of the skirt.

The bridges 56 are relatively thin in cross-section in comparison to the cross-sectional width of the band 26. In the preferred embodiment, the bridges have a thickness 'T' on the order of 0.010 to 0.035 inches, with a preferred size range of between 0.012 to 0.030 inches. In addition, the bridges 56 are relatively short compared to the band 26, having a height 'H' on the order of from 0.030 to 0.060 inches.

Although they are depicted as being generally cuboidal, the bridges 56 may be provided in any desired shape which will suit a given application. The bridges 56 are disposed about the band 54 in spaced arrangement to facilitate separation of the band from the skirt 30 upon the initial opening of the closure 10. The specific number and spacing of the bridges 56 may change depending on the particular closure and the materials employed. It is also preferred for operational purposes that the bridge formations 56 be disposed on the upper surface 58 of the breakaway band 54 to engage the lower surface of the skirt 0 at the approximate midpoint.

An annular flange 60 incorporates the upper surface 58 of the breakaway band 54 and projects generally radially away from the container neck 16. In the preferred embodiment, the flange 60 is provided with a vertical thickness on the order of 0.025 to 0.035 inches, with 0.030 inches being preferred. These dimensions have been found to provide optimum strength for the amount of material used. A vertically depending leg portion 62 is integrally fixed to the flange 60 to generally define an inverted "L" shape of the breakaway band 54.

The band 54 also has an outer surface 64 and an inner surface 66. An inwardly projecting, radiused annular bead 68 is provided on the inner surface 66 and is integrally joined to the leg portion 62. The bead 68 is vertically spaced below the flange 60 by a hinge portion 70 having a relatively thin cross-section, preferably in the approximate range of 0.010 to 0.035 inches. The hinge portion is dimensioned to provide sufficient flexibility to permit the band 54 to clear the breaker ledge 24 and avoid frictional interference commonly generated during closure application, while having sufficient rigidity to support the bead 68 and the flange 60.

A significant feature of the present closure 10 is the provision of a plurality of support formations for preventing distortion of the breakaway band during application of the closure upon the container. In the preferred embodiment, the support formations take the form of ribs or gussets 72 which are generally triangular in shape, and integrally join the underside of the flange 60 with the outer surface 64 of the breakaway band 54. A generally horizontally disposed, upper edge 74 engages the flange 60 and a vertical edge 76 engages the outer surface 64 of the breakaway band 54.

It has been found that a preferred thickness for the gussets 72 is in the approximate range of 0.007 to 0.025 inches, with an optimum range of approximately 0.010 to 0.020 inches. The exact number of gussets 74 will depend on the size of the closure 10 and the application, but anywhere between 8 and 20 gussets is preferred. In operation, and referring to FIGS. 1-3, the closure 10 is threaded upon the neck 16 of the container 12 with the threads 38 of the closure engaging the threads 22 of the neck 16. Once the lower edge 36 of the skirt 30 is placed in closely adjacent relationship with the ratchet formations 20 of the anti-backoff ring 18, the closure 10 may be tightened about the container 12, with the recess formations 42 contacting the ratchet formations 20 of the container 12. This tightening action causes an audible and tactile vibration between the formations 20 and the peripheries of the recesses 42, which indicates to the user that the closure 10 is locked upon the container 12.

At the same time, the breakaway band 54 is pressed over the annular shoulder 24. The tapered configuration of the shoulder 24 permits a one-way engagement between the bead 68 and the neck 16, in that on the assembled closure 10, relatively low force is required to thread the bead over the shoulder 24, and once over the shoulder, the bead 68 makes it difficult for the band 54 to move upwards.

The engagement of the bead 68 with the shoulder 24 thus facilitates the severing of the bridge formations 56 and the breaking away of the band 54 from the closure body 12 once the closure 10 is rotated in a counterclockwise manner. This is because the shoulder 24 holds the bead 68 and prevents upward movement of the band 54. When the closure 10 is snugly secured upon the container neck 16, the ratchet formations 20 matingly engage the recesses 38. In this manner, the closure is also prevented against back-off motion which may cause the closure to slightly open. While the closure 10 may be somewhat difficult to open by some consumers, it does not provide excessive resistance to opening. To effect removal from the container 12, it is not necessary to apply axial pressure to the closure 10 in a "push-and twist" motion due to its resiliently deformable construction.

An advantage of the present closure 10, with the support gussets 72 on the breakaway band 54, is that excessive flexing at the hinge portion 70 is prevented. Frictional interference generated between the bead 68 and the breaker ledge or shoulder 24 may cause deformation of the tamper evident band in conventional closures. The lack of sufficient support in this area on such prior art closures tended to cause unwanted tucking of the breakaway band during application of the closure upon the container. Closures exhibiting such tucking were often unusable due to their appearance of having been tampered with.

Another advantage of the presence of the gussets 72 is that the stress on the bridge formations 56 during application is somewhat reduced, thus reducing the potential for premature severing. In addition, additional support provided by the gussets 72 helps to retain the severed breakaway band upon the container 12 when the closure is opened, to better indicate tampering.

While a particular embodiment of the closure of the invention has been shown and described, it will be appreciated by those skilled in the art that changes and modifications may be made thereto without departing from the invention in its broader aspects and as set forth in the following claims.

I claim:

1. A molded tamper-evident closure for a container having a neck, comprising:

a generally planar top portion with an outer peripheral edge;

an annular skirt depending from said peripheral edge and having a lower edge margin;

an annular breakaway band having a top surface and a bottom surface, said top surface including a plurality of spaced frangible bridge formations integrally joined to said lower edge margin of said skirt;

said breakaway band further including a generally radially extending annular flange portion incorporating said top surface, and a generally vertically depending leg formation integral with said flange portion to generally define an inverted "L" shape;

said breakaway band being provided with a support means for preventing distortion of said breakaway band as said closure is applied to the container; and said support means including at least one gusset member connecting an underside of said flange portion to an outer surface of said leg formation.

2. The closure as defined in claim 1 wherein said lower edge margin of said skirt is provided with at least one open bottomed, open sided recess formation for engaging a plurality of radially projecting ratchet formations on the neck of the container.

3. The closure as defined in claim 2 wherein each said at least one recess formation is generally trapezoidal in configuration, having an angled end and a radiused end.

4. The closure as defined in claim 1 wherein said annular flange portion has a thickness of approximately 0.025 to 0.035 inches.

5. The closure as defined in claim 1 wherein said leg formation includes a hinge portion having a relatively thin cross-section.

6. The closure as defined in claim 5 wherein said hinge portion has a thickness in the approximate range of 0.010 to 0.035 inches.

7. The closure as defined in claim 1 further including a radiused inwardly extending bead integral with an inner surface of said leg formation.

8. The closure as defined in claim 1 wherein each said gusset member has a thickness in the approximate range of 0.0007 to 0.025 inches.

9. A molded tamper-evident, back-off resistant closure for use with a container having a neck with at least one radially extending ratchet formation on the neck, comprising:

a generally planar top portion with an outer peripheral edge;

an annular skirt depending from said peripheral edge and having a lower edge margin, said lower edge margin having at least one open bottomed, open-sided recess formation for engaging the at least one radially projecting ratchet formation on the neck of the container as said closure is applied to the container;

an annular breakaway band having a top surface, a bottom surface, an inner surface and an outer surface, said band provided with a plurality of generally vertically extending frangible bridge formations integrally joined at upper ends thereof to said lower edge margin of said skirt; and said outer surface of said breakaway band being provided with a support means for preventing circumferential distortion of said breakaway band as said closure is applied to the container, said support means including a plurality of gusset members connecting an underside of said flange portion to an outer surface of said leg formation.

10. The closure as defined in claim 9 wherein said breakaway band further includes an annular flange portion incorporating said top surface and having a thickness of approximately 0.025 to 0.035 inches.

11. The closure as defined in claim 9 wherein said breakaway band further includes an annular flange portion incorporating said top surface and a generally vertically depending leg formation integral with said flange portion to generally define an inverted "L" shape.

12. The closure as defined in claim 11 further including a radiused inwardly extending bead integral with an inner surface of said leg formation.

13. The closure as defined in claim 9 wherein said gusset member has a thickness in the approximate range of 0.010 to 0.020 inches.

14. A molded tamper-evident closure for a container having a neck, comprising:

a generally planar top portion with an outer peripheral edge;

an annular skirt depending from said peripheral edge and having a lower edge margin;

an annular breakaway band having a top surface and a bottom surface, said top surface including a plurality of spaced frangible bridge formations integrally joined to said lower edge margin of said skirt;

an outer surface of said breakaway band being provided with a plurality of support means for preventing distortion of said breakaway band as said closure is applied to the container;

said breakaway band further includes a generally radially extending annular flange portion incorporating said top surface, a generally vertically depending leg formation integral with said flange portion to generally define an inverted "L" shape, and a radiused inwardly extending bead integral with an inner surface of said leg formation.

* * * * *